United States Patent [19]

Heinrich et al.

[11] 4,437,401

[45] Mar. 20, 1984

[54] SEPARATOR PLATE FOR TYPE BAND PRINTER

[75] Inventors: Horst Heinrich, Stuttgart; Günter R. Herrmann, Sindelfingen; Manfred Schmidt, Deckenpfronn, all of Fed. Rep. of Germany

[73] Assignee: International Business Machines Corporation, Armonk, N.Y.

[21] Appl. No.: 522,249

[22] Filed: Aug. 11, 1983

Related U.S. Application Data

[63] Continuation-in-part of Ser. No. 362,424, Mar. 26, 1982, abandoned.

[30] Foreign Application Priority Data

Apr. 23, 1981 [DE] Fed. Rep. of Germany ..... 3116127

[51] Int. Cl.[3] ..... B41J 1/20

[52] U.S. Cl. ..... 101/93.14; 400/248; 101/336

[58] Field of Search ..... 101/93.03, 93.13, 93.14, 101/111, 336, DIG. 27

[56] References Cited

U.S. PATENT DOCUMENTS

| | | | |
|---|---|---|---|
| 3,983,803 | 9/1974 | Thomas et al. | 101/93 |
| 4,061,219 | 12/1977 | Nishikawa et al. | 400/229 X |
| 4,165,188 | 8/1979 | Rempel | 400/248 X |
| 4,211,166 | 7/1980 | Hardt | 101/111 |
| 4,226,180 | 10/1980 | Matsui | 101/111 |
| 4,311,401 | 1/1982 | Hiki et al. | 101/336 X |

FOREIGN PATENT DOCUMENTS

| | | | |
|---|---|---|---|
| 2015171 | 10/1971 | Fed. Rep. of Germany . | |
| 55-133982 | 10/1980 | Japan | 101/336 |
| 1546052 | 1/1978 | United Kingdom . | |

OTHER PUBLICATIONS

IBM Technical Disclosure Bulletin to E. J. Bonafino et al., vol. 19, No. 2, 7/76, p. 439, "Ribbon Retainer".

IBM Technical Disclosure Bulletin to J. E. Drejza, vol. 23, No. 9, 2/81, "Duplex Printing with a Band Printer", pp. 4101–4103.

IBM Technical Disclosure Bulletin to G. C. Matuck, et al., vol. 16, No. 3, 8/83, "Detentable Ribbon Shield", pp. 834–835.

*Primary Examiner*—Edgar S. Burr
*Assistant Examiner*—John A. Weresh
*Attorney, Agent, or Firm*—J. Jancin, Jr.; E. W. Galbi; J. F. Villella, Jr.

[57] ABSTRACT

A separator plate for a type band printer is located between the print paper and a ribbon so as to prevent the ribbon from contacting the paper. The upper edge of the separator plate is located adjacent to the print line and pushes the paper away from the ribbon against the hammer plate. The separator plate is affixed to the printer.

3 Claims, 4 Drawing Figures

SEPARATOR PLATE FOR TYPE BAND PRINTER

DESCRIPTION

This application is a continuation-in-part of copending U.S. application, Ser. No. 362,424, filed Mar. 26, 1982, by H. Heinrich, G. Herrmann, and M. Schmidt, now abandoned.

1. Technical Field

This invention relates to a type band printer having individual type elements affixed to a rotating continuous type band or type chain.

2. Background Art

In order to achieve a high printing capacity in type band printers, it is necessary to have the distance between the type band and the print hammers as small as possible in order to keep the hammer path short. Both the print paper and the ribbon are passed through a narrow gap between the type band and the hammers or hammer plate. Since the paper feed is vertical, but the ribbon feed horizontal, there are relative movements between paper and ribbon. Due to these relative movements, there is the risk of the ribbon resting against the paper during the paper or ribbon transport. When this occurs, undesired ink traces are left at the upper line edge of the print line. This smudging of the print paper adversely effects the print quality.

This paper smudging causes particular problems if the document to be printed is to be machine read by an optical reader, that is, if the document is to be printed in optical character recognition print. When a test having such smudges is machine read, error signals are generated thus indicating that the document is not fit for machine reading.

It is known to provide, in a type band printer having an ink dispenser between the print paper and the type, an impact resistant foil of synthetic material extending in band form between the ink dispenser and the type. Such foil can be incremented either in parallel to or transversely to the print line. However, the purpose of this feature is to protect the type against smudging by the ink dispenser, and to prevent a perforation of the ink dispenser carbon paper by the type. Undesired contact between print paper and ribbon cannot be prevented by this arrangement.

It is also known to provide an intermediate band which moves between the circulating type band and the platen. It is known that in type belt printers the type band is exposed to some abrasion, particularly at the platen since at that point it slides over the platen at a high speed. This intermediate band which preferably is made of a flexible material prevents or reduces this abrasion. This intermediate band is effective in the type band/platen region exclusively and does not have any influence on the coaction of paper and ribbon.

Accordingly, it is an object of this invention to provide an improved type band printer.

It is another object of this invention to eliminate undesired contact between paper and ribbon in a type band printer.

It is yet another object of this invention to provide a type band printer wherein a uniform tension is produced on the paper so as to counteract any fluttering motion in the paper advance.

It is still a further object of this invention to provide a type band printer wherein a longitudinal fold line and an upper edge of a separator plate are substantially coextensive with the lower edge of a print line so as to eliminate undesired contact between paper and ribbon.

DISCLOSURE OF THE INVENTION

The present invention provides an elastic separator plate, to be used in a type band printer, which exerts a force on the paper away from the ribbon. The upper edge of the separator plate extends directly adjacent to and is substantially coextensive with the print line. Further, the separator plate has an opening so as to enable print hammers to pass through the opening and strike the ribbon, thus making a mark on the paper. The separator plate is fixed to the frame of the printer directly beneath the platen.

BEST MODE FOR CARRYING OUT THE INVENTION

Figure 1:
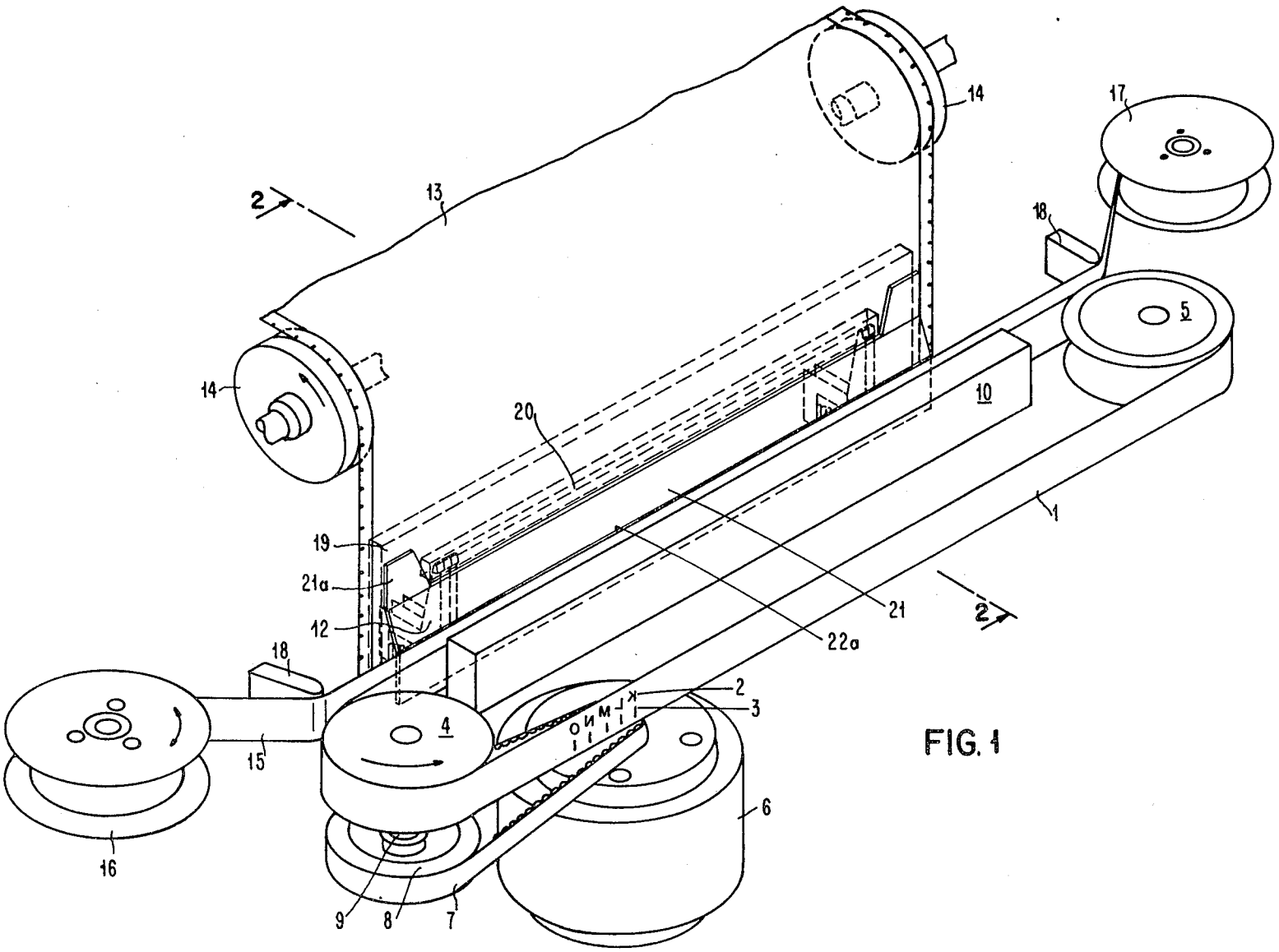
FIG. 1 is a perspective view of the type band printer of the present invention.
Figure 2:
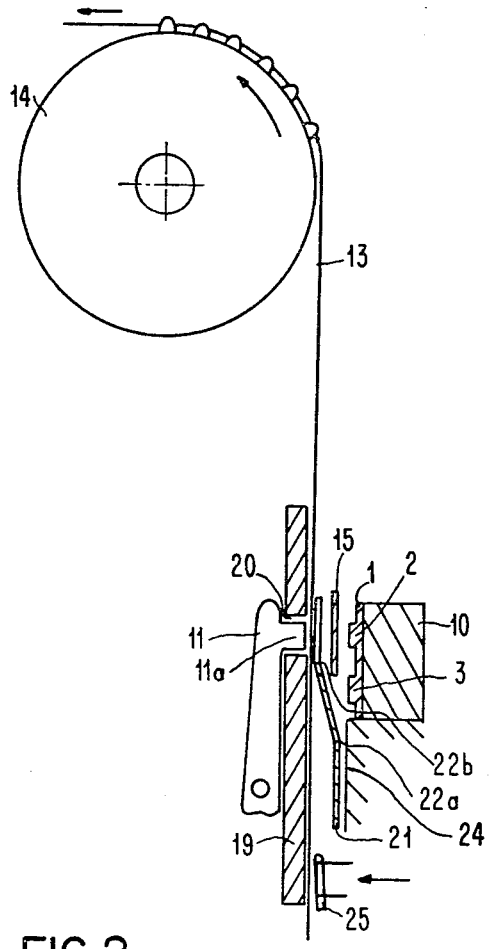
FIG. 2 is a sectional view of the type band printer of FIG. 1 in plane 2—2.

The type band printer of FIGS. 1 and 2 comprises a continuous type band 1 of steel with one track for alphanumeric and special type elements 2, and another track for timing marks 3. Type band 1 is wrapped around driving roller 4 and tension roller 5. Synchronous motor 6 has a shaft (not shown) which engages toothed belt 7. Toothed belt 7 is also engaged by toothed belt disk 8 such that when the shaft of synchronous motor 6 rotates, toothed belt disk 8 also rotates. Toothed belt disk 8 is connected to shaft 9 such that when toothed belt disk 8 rotates, shaft 9 also rotates in the same direction. Shaft 9 is in turn connected to drive roller 4 such that when shaft 9 rotates, driving roller 4 rotates in the direction of the arrow. This in turn drives type band 1.

Platen 10, which is designed as an elongated block and made preferably of a suitable platen material, for example, a non-ferrous metal, has a two-fold function. The first function is the standard platen function, that is, as an impact receiving plate for print hammers 11 arranged on the rear side of the printer and print hammer unit 12. The second function of platen 10 is to guide type band 1.

Paper 13 moves in the gap between print hammers 11 and type band 1, and is advanced by means of sprocket wheels 14 driven in the direction of the arrow. A ribbon 15 is provided between paper 13 and type band 1 for executing a reciprocating movement between a first spool 16 and a second spool 17. Magnetic sensors 18 control the switching of ribbon 15 when the respective supply spool is almost empty or the respective take-up spool is almost full. To guide paper 13, a hammer plate 19 is vertically arranged on the front side of print hammer unit 12. An aperture 20 in hammer plate 19 permits the heads 11*a* of print hammers 11 to operate in the direction of type band 1 and platen 10.

Figure 3:
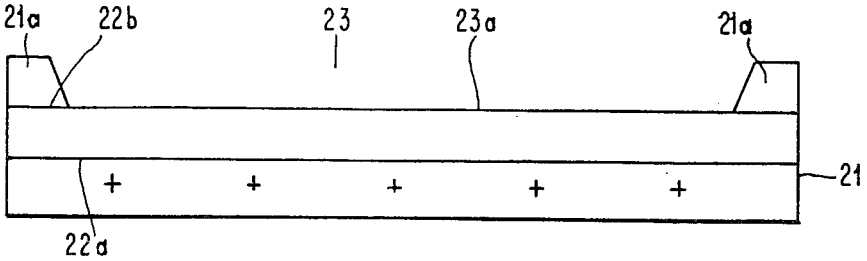
FIG. 3 is a view of the separator plate between ribbon and paper.

As shown in FIGS. 1 and 2, separator plate 21 protrudes between paper 13 and ribbon 15. As shown in FIGS. 2 and 3, separator plate 21 has two longitudinal fold lines 22*a* and 22*b*, and an opening 23 which is on the level of the print line. Opening 23 is slightly longer than the row of print hammers. Thus opening 23 allows hammers 11 to pass through and strike type elements 2. Separator plate 21 also has side arms 21*a* protruding on both sides of the print line i.e., the margins, into the gap between ribbon 15 and paper 13.

Separator plate 21 is easily fixed to frame part 24 by means of screws (FIG. 3) or by glueing. The material used for separator plate 21 is preferably a foil of transparent synthetic material, for example, a polyester foil. The thickness of separator plate 21 is between 0.2 millimeters and 0.5 millimeters, and it is such that under the influence of its intrinsic elasticity, separator plate 21 continously exerts a sufficient force onto paper 13 to separate it from ribbon 15 and to push the paper against hammer plate 19. By pushing paper 13 away from inked ribbon 15, the installation of inked ribbon 15 in the printer is facilitated.

Due to longitudinal fold lines 22*a* and 22*b*, separator plate 21 has a cross section in the form of a flattened Z. The lower leg of the separator plate 21 rests smoothly against frame part 24 to which it is affixed. The upper edge 23*a* and longitudinal fold line 22*b* rests against paper 13, pushing the paper against hammer plate 19. Separator plate 21 achieves its maximum effect when upper edge 23*a* and longitudinal fold line 22*b* are substantially coextensive with the lower edge of the print line.

Figure 2A:
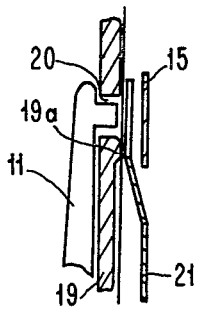
FIG. 2*a* is a part sectional view of the type band printer showing an alternative design of the hammer plate from that shown in FIG. 2.

FIG. 2*a* shows an alternative design of hammer plate 19. Hammer plate 19 has a nose 19*a* immediately below aperture 20 on the side facing separator plate 21. Separator plate 21 rests with its upper edge 23*a* and fold line 22*b* against nose 19*a* of hammer plate 19. This has the effect of improving the tensioning of paper 13.

After the insertion of paper 13 and the introduction of ribbon 15 into the printer, the printing process is ready for operation. Print hammers 11 are actuated when the respective character of type band 1 is in its print position. After the printing of a complete line, paper 13 is advanced by sprocket wheels 14 by one step in the direction of the arrow. This has the effect of setting the paper to the next print line. During the time that the paper is advancing, a braking bar 25, shown schematically in FIG. 2, is released. At all other times, braking bar 25 pushes paper 13 against hammer plate 19, thus applying tension to the paper. Braking bar 25 may be, for example, an electromagnet operated against a spring force, such that when the electromagnet is released, the spring force causes braking bar 25 to move away from hammer plate 19.

Separator plate 21 prevents smudging both in the area to be printed on the the print line and in the margins of the print line. Prevention of smudging in the margin area is accomplished by side arms 21*a* which physically prevent ribbon 15 from touching paper 13 in those areas. In the area in which printing is desired, separator plate 21 pushes paper 13 towards hammer plate 19 and away from ribbon 15. In this manner, there is no smudging of paper 13 by ribbon 15 on the print line.

Separator plate 21 also contributes to the tensioning of paper 13. Separator plate 21 continually pushes paper 13 against the surface of hammer plate 19. By so doing, the tension applied to paper 13 is increased over that provided by braking bar 25. This extra tensioning effect is particularly applicable to the alternative design of hammer plate 19 shown in FIG. 2A.

While the invention has been particularly shown and described with reference to the preferred embodiment thereof, it will be understood by those skilled in the art that various changes in form and detail may be made therein without departing from the spirit and scope of the invention.

What is claimed is:

1. A type band printer for printing characters on a print line comprising:

an endless type band;

a platen contiguous with said endless type band for guiding said endless band;

a plurality of type elements affixed to said endless type band and lying in the same plane as said print line;

means for moving said endless type band in a direction parallel to the print line;

print paper;

means for feeding said print paper;

an inked ribbon located between said paper and said endless type band in the same plane as said plurality of type elements;

means for feeding said inked ribbon parallel to said endless type band;

a hammer plate, located on the opposite side of said inked ribbon from said endless type band and said platen, having an opening therein located in the same plane as said plurality of type elements;

a print hammer head capable of being thrust through said opening in said hammer plate so as to drive said print paper and said ribbon onto one of said plurality of type elements; and an elastic separator plate, composed of polyester foil between 0.2 mm and 0.5 mm thick, located between said print paper and said inked ribbon for preventing said inked ribbon from contacting said print paper during those times when either the inked ribbon or the print paper is being fed, by exerting a force caused by its inherent elasticity on said print paper in a direction away from said inked ribbon and said platen, and toward said hammer plate, said elastic separator plate comprising, a longitudinal fold line substantially coextensive with the bottom of said print line for maintaining said print paper against said hammer plate across the entire width of said print paper, an upper edge substantially coextensive with the bottom of said print line, side arms located at the ends of said upper edge, said side arms interposed between said print paper and said ribbon for preventing said print paper from contacting said ribbon in the areas of said side arms, and an opening located between said side arms and bounded by said upper edge, whereby said print hammer head is thrust through said opening in said elastic separator plate.

2. A type band printer according to claim 1 wherein said hammer plate further comprises a nose located immediately below the opening in said hammer plate for applying tension on said print paper in response to the force of said elastic separator plate on said hammer plate.

3. A type band printer for printing characters on a print line comprising:

an endless type band;

a platen contiguous with said endless type band for guiding said endless band;

a plurality of type elements affixed to said endless type band and lying in the same plane as said print line;

means for moving said endless type band in a direction parallel to the print line;

print paper;

means for feeding said print paper;

an inked ribbon located between said print paper and said endless type band in the same plane as said plurality of type elements;

means for feeding said inked ribbon parallel to said endless type band;

a hammer plate, located on the opposite side of said inked ribbon from aid endless type band and said platen, having an opening therein located in the same plane as said plurality of type elements;

a braking bar for pushing said print paper against said hammer plate thereby applying tension to said print paper;

a print hammer head capable of being thrust through said opening in said hammer plate so as to drive said print paper and said ribbon onto one of said plurality of type elements; and an elastic separator plate, composed of polyester foil between 0.2 mm and 0.5 mm thick, located between said print paper and said inked ribbon for preventing said inked ribbon from contacting said print paper during those times when either the inked ribbon or the print paper is being fed, by exerting a force caused by its inherent elasticity on said print paper in a direction away from said inked ribbon and said platen, and toward said hammer plate, said elastic separator plate comprising, a longitudinal fold line substantially coextensive with the bottom of said print line for maintaining said print paper against said hammer plate across the entire width of said print paper, an upper edge substantially coextensive with the bottom of said print line, side arms located at the ends of said upper edge, said side arms interposed between said print paper and said ribbon for preventing said print paper from contracting said ribbon in the areas of said side arms, and an opening located between said side arms and bounded by said upper edge, whereby said print hammer head is thrust through said opening in said elastic separator plate.

* * * * *